US007568947B2

(12) United States Patent
Schuster et al.

(10) Patent No.: US 7,568,947 B2
(45) Date of Patent: Aug. 4, 2009

(54) HIGH CURRENT GRADIENT COIL-TO-COAXIAL LINE PLUGGED CONNECTION

(75) Inventors: Johann Schuster, Oberasbach (DE); Stefan Stocker, Grossenseebach (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 12/031,825

(22) Filed: Feb. 15, 2008

(65) Prior Publication Data

US 2008/0200067 A1 Aug. 21, 2008

(30) Foreign Application Priority Data

Feb. 15, 2007 (DE) ..... 10 2007 007 541

(51) Int. Cl.
*H01R 9/05* (2006.01)

(52) U.S. Cl. ..... 439/581

(58) Field of Classification Search ..... 439/63, 439/578, 580, 581, 582, 583, 584, 585
See application file for complete search history.

(56) References Cited

U.S. PATENT DOCUMENTS 4,326,769 A * 4/1982 Dorsey et al. ..... 439/21

FOREIGN PATENT DOCUMENTS

DE 695 05 879 T2 6/1999
DE 20 2004 015 501 U1 2/2005

* cited by examiner

*Primary Examiner*—Ross N Gushi
(74) *Attorney, Agent, or Firm*—Schiff Hardin LLP

(57) ABSTRACT

A high current coaxial connection with two plug elements that can be connected with one another, in particular to connect a current-carrying coaxial line to a gradient coil of a magnetic resonance apparatus, has two spring contact elements arranged coaxially to one another to establish the electrical contact between the two plug elements.

4 Claims, 2 Drawing Sheets

HIGH CURRENT GRADIENT COIL-TO-COAXIAL LINE PLUGGED CONNECTION

BACKGROUND OF THE INVENTION

1. Field of the Invention

The invention concerns a high current coaxial connection of the type formed by two plug elements that can be connected with one another, in particular for connection of a current-carrying coaxial line to a gradient coil of a magnetic resonance apparatus, as well as a gradient coil with a connected high current coaxial line.

2. Description of the Prior Art

In addition to other apparatuses, magnetic resonance apparatuses (for example) in which the examination subject is exposed to a strong magnetic field for generation of image exposures are known from medical technology. This leads to an alignment of the nuclear spins of the atoms located in the magnetic field, and the measurement signal for the imaging is obtained by the excitation of oscillations by radio-frequency energy. In order to produce a spatial coding of the signals, magnetic gradient fields are used that are generated along the three spatial directions using coils known as gradient coils. The coils for the individual spatial directions are combined into a gradient coil system that, under the circumstances, include a number of individual coils associated with the three spatial directions and is often also designated as a "gradient coil" for short. This gradient coil is spatially fixed in a sealing compound in which it is cast.

A high current must be supplied to the gradient coil for generation of the gradient fields. The currents employed lie at a few 100 A. For instance, 500-900 A is a typical value.

Presently it is frequently the case that, since no suitable high current coaxial connections are available for connection of such a gradient coil, the coaxial lines must be split into two individual conductors before the connection to the coil, with the individual conductors in turn being screwed down at the coil. The high current that must be fed to the gradient coil thus no longer flows coaxially. This leads to high alternating forces in the scatter field of the magnet due to the individual conductors, and thus to a high dynamic material load. This presents the danger of a breakage or a loosening of the contact, and burning or carbonizing can arise due to the high energy at the general purpose amplifier (GPA).

To address this problem, attempts have already been made to make the connection of the gradient coil by means of a high current coaxial connection that includes a plug and a counter-plug that can be detachably connected therewith, the plug exhibiting a contact bolt (housed in an insulation bushing) that can be axially displaced in a direction counter to a reset force. The insulation bushing is housed in a contact bushing that is overlapped by a coupling mounting, while the counter-plug includes a central counter-contact bolt that is held in an insulation bushing that is in turn housed in a counter-contact bushing that interacts with the coupling mounting for connection of the plug with the counter plug. Upon connection of the plug with the counter-plug, the contact bushing as well as the insulation bushing are then moved relative to a contact bolt abutting the counter-contact bolt to establish a reset force, and the contact bushing is moved against the counter-contact bushing. The reset force for such a high current coaxial connection can be generated, for example, by a spring element or a spring element contact.

However, the contact surfaces via which the electrical contact is established lie transverse or perpendicular to the axis of the plug connection, such that a relatively rigid mounting is required to ensure a permanent electrical connection (in particular with regard to forces that act in the axial direction).

SUMMARY OF THE INVENTION

An object of the present invention is to provide a high current coaxial connection as well as a gradient coil with a connected high current coaxial line that are improved with regard to the aforementioned features.

This object is achieved in accordance with the invention by a high current coaxial connection of the aforementioned type that has two spring contact elements arranged coaxially to one another to establish the electrical contact between the two plug elements.

The connection is thus fashioned such that the electrical contact for the inner and outer conductors is established by two spring contact elements of the plug elements, which spring contact elements are arranged coaxially to one another.

In contrast to the conventional practice, the coaxial lines for the gradient coils (which coaxial lines have an inner conductor and an outer conductor) are thus not split into two individual conductors and screwed down at the coil and, moreover, no electrical contacting transverse to the axis direction occurs with contact bolts or bushings. Instead, the electrical contact is established by two coaxial spring elements. In the inventive connection the spring contact elements thus do not serve for generation of an axial reset force but rather are arranged coaxially to one another and establish the electrical contact for the two polarities, namely between the outer and inner conductors of the coaxial line. The spring contact elements can be fashioned exclusively from springs or can include further components that serve directly or indirectly for generation of a spring force, for example in order to connect individual springs with one another.

Since the currents are coaxially conducted into the sealing compound of the gradient coil, the electromagnetic forces are kept low. One half of the plug (thus one plug element) is, for example, firmly connected with the gradient coil or is cast therewith in the sealing compound, thereby permitting the connection of the other plug element without problems. The counterpart (thus the second plug element) is connected with the gradient coil feed line.

In the inventive high current coaxial connection, two spring contacts are thus respectively inter-nested and merged in a simple manner into a connection for both polarities for the outer and inner conductor of the coaxial connection or the coaxial line to be connected. The contact principle for the plug is the connection with the aid of spring contact elements that are arranged around the axis of the coaxial connection. The springs or spring elements can even be arranged in part on the one or other plug element or on various plug elements. In particular, an arrangement of the springs or spring elements of the respective spring contact at the gradient coil-side plug element is appropriate. The deforming effect ensues in the radial direction. The springs or spring contact elements are constructed from an electrically-conductive material, thus in particular from a metal or a metal alloy.

At least one spring contact element can be arranged directly between contact surfaces (in particular between coaxially aligned contact surfaces) of the two plug elements that are to be brought into contact with one another (which contact surfaces proceed into the plug connection) to establish the electrical contact for a respective conductor of the coaxial line of the high current coaxial connection. In this case the electrical contact for the outer or inner conductors that proceed into the plug connection (thus the connection for both polarities) is directly produced by the spring, which thus in the invention serves not only for bringing the contact surfaces together without being directly placed on or between the contact surfaces, but also for enabling the contacting itself.

For example, the spring contact elements are can be flat springs with a radial effective direction on likewise coaxial contact surfaces that are thus brought into contact with one another by the springs. In this form of the contacting, a certain clearance for the connection exists transverse to the axis direction with the aid of the coaxial spring contact elements. Moreover, a certain axial tolerance compensation is achieved by the contact surfaces being fashioned longer in the axis direction.

When forces (such as, for example, separation or compression or forces in the axial direction) thus act on the two plug elements, a displacement in the axial direction does not represent a problem for the securing or ensuring of a contact insofar as the contact moves within certain limits that are predetermined by the axial length of the spring contact elements. In contrast to contacting with perpendicular contact surfaces that must lie directly on one another for a secure contacting, a certain longitudinal displacement of the plug elements counter to one another can be tolerated without further measures in the contacting aligned in the axis direction. This tolerance compensation in the axial direction is very advantageous, not least due to the rigidity of the current feed lines employed.

At least portions of surfaces of bolts and/or bushing elements arranged in the axial direction of the high current coaxial connection can be used to establish the electrical contact of the contact surfaces. Furthermore, contact bolts or contact bushings can be used wherein the actual electrical contact is mediated by the spring contact elements. The bolts or bushings are thus arranged in the axial direction. Preferably, all surfaces provided for establishment of the contact or the elements that carry these surfaces, are aligned axially, with the springs or spring contact elements either being directly applied on the contact surfaces or being brought into contact therewith upon plugging of the two plug elements together.

Other contact surfaces or contact surfaces of elements fashioned differently can naturally be used. It is only necessary that the contact surfaces are matched to the coaxial alignment of the spring contacts so that a secure contact is ensured.

According to the invention, the surface closest to the axis can be the contact surface of a bolt element and the further contact surfaces can be surfaces of bushing elements. A bolt element on whose surface (which has the shape of a cylinder shell) the contact face is fashioned for the establishment of the electrical contact with the aid of the spring contact elements is thus provided (for the inner conductor) centrally with regard to the axis of the connection. The connection to a further axially distal contact surface at the other plug element is established by the coaxially inner spring contact element, this axially distal contact surface being a contact surface of a bushing, thus an element that is fashioned as a hollow cylinder. The further axially distal contacting for the outer conductor is achieved by the interlocking (mediated with the aid of the second spring contact element) of two bushing elements of the two plug elements with their respective hollow cylindrical contact surfaces.

At least one spring contact element can form a cylinder shell. The spring or the contact element with further components is thus fashioned such that, overall, a cylinder shape arises, but naturally certain interstices can remain, for example between individual spring elements. The spring contact element can be formed by a number of individual springs in the formation of the cylinder shell. These can be arranged, for example, at certain intervals (spacings) on a contact surface of a bushing element such that overall the cylindrical design results. It is normally advantageous when the two spring contact elements have an identical design to the effect that both form an identical shape (thus for example a cylinder shell). The difference then merely lies in the radius of the cylinder shell since different radii must be present due to the coaxial arrangement of the spring contact elements around the common axis of the plug connection.

Furthermore, at least one spring contact element can be fashioned as a lamella (plate or fin). It is thus a spring composed of a number of lamellar individual springs or a spring or a spring element that has transverse connections between the individual lamellae, wherein the lamellae are arranged at a specific distance along a surface (thus a contact surface for the establishment of an electrical contact). A large surface and high stability can be achieved by a suitable connection of the lamellae spacing. In particular given a larger spacing and a suitable elastic strength, it is possible to enable radial tolerance compensation with regard to radially acting forces.

The lamellae of the spring contact element can be arranged in the direction of the longitudinal axis of the high current coaxial connection. The lamellae are then curved or elastically deformed, for example somewhat to the side. The lamellae thus extend parallel to the axis corresponding to the overall coaxial design of the contacting with the coaxial spring contact elements. The axis-parallel arrangement of the lamellae is the most straightforward and represents a relatively simple design. This arrangement offers the advantage that the elastic forces that act upon loading of the spring elements are comparable in the axis direction. However, an angled arrangement of the lamellae or an arrangement of the lamellae transverse to the axis of the coaxial connection is likewise possible. However, the arrangement in the direction of the longitudinal axis is particularly suitable with regard to the tolerance compensation in the axis direction, since in such an arrangement each lamella is still involved in the contacting even given a small displacement along the axis. The lamellae can be fashioned directly on associated contact bushings and the like, for example welded or soldered. Gluing is also possible, likewise a screwed or riveted mounting, for which the individual lamellae advantageously have extending transverse connections such as webs that offer attachment possibilities.

As noted above, it is particularly advantageous when the plug elements can be displaced counter to one another within a specific range without interrupting the electrical contact in the axial direction of the high current coaxial connection. Tolerance compensation in the axis direction (thus along the longitudinal axis of the coaxial connection) is thereby achieved. Due to this axial tolerance compensation, the electrical contacting can be ensured even given vibrations that can occur, for example, in the environment of the gradient coils upon operation of the magnetic resonance tomography apparatus. Furthermore, such an axial tolerance compensation is advantageous in view of the high weight (for example, 800 kg) of the coils used in magnetic resonance tomography. Tearing away of the contact and damage to components can be effectively avoided due to the tolerance compensation. The magnitude of the axial tolerance compensation depends on (in addition to the field of use) the dimensions that the springs (which are, for example, fashioned like lamellae) exhibit with regard to the contact region in the longitudinal direction of the coaxial connection. Depending on the application, compensation in the sub-millimeter or millimeter range up to the centimeter range is possible.

The electrical contact for the conductors of the coaxial line associated with the high current coaxial connection are appropriately separated from one another by at least one insulator element. The electrical contacts that are associated with the outer conductor or the inner conductor extending into the coaxial connection are thus insulated from one another. The insulator material is selected such that the desired dielectric loss factor results. In the general case the insulator element or insulator elements separate not only the electrical contacts but also overall the inner or outer conductor of the coaxial connection in the region of the plug connection or in the region of the coaxial cable. In the inventive high current coaxial connection, the insulator elements for a particular contact can be fashioned in multiple parts and can be present at both plug elements in order to fashion overall a uniform, sealed insulator part upon inter-plugging.

At least one pin element (in particular made from a glass fiber-reinforced plastic) and/or a collar with a nut for fixing the relative position of the two regions of the plug element arranged coaxial to one another and carrying the contact surfaces, can be provided at least one plug element. Such a pin made from a glass fiber-reinforced plastic or another suitable material can be used in order to secure the different regions of an individual plug element in their position relative to one another. This can likewise or additionally be achieved by arrangements with threaded nuts. The pin element or the pin elements can likewise appropriately directed through insulator elements, such that overall a stabilization of the plug element is achieved.

Moreover, the invention concerns a gradient coil with connected high current coaxial line as a part of a magnetic resonance apparatus in which the high current coaxial line is connected with a high current coaxial connection as described above. The gradient coil is thus connected by means of the connection to the high current coaxial line supplying the current, the high current coaxial line supplying a current of several of 100 A. This connection is produced by two coaxial spring contact elements as described above. Each spring contact element thereby establishes the connection for one of the two conductors of the coaxial line. A secure contacting that is tolerant with regard to longitudinal displacements in the direction of the coaxial axis is thereby achieved. The occurrence of high alternating forces in the scatter field of the magnet of the magnetic resonance apparatus and the high dynamic material loading associated with this can be avoided. The contact is securely ensured, for example by springs fashioned like lamellae.

One plug element with the high current coaxial line can be connected according to the invention while the other plug element is arranged at the gradient coil. Only one insertion of the plug element connected with the high current coaxial line is thus required for supply of the current.

A plug element can advantageously be cast or laminated on the gradient coil. In this case a fixed or non-detachable contact to the gradient coil results. The contact to the gradient coil thus must only be established once before the casting procedure or the lamination occurs. By a positive and non-positive fixing of the one plug element by casting or lamination, it is ensured that no disruptive movements or loosenings of the connection to the gradient coil can occur in the connection region. A current connection that is more secure and largely insusceptible to interruption can thus be realized overall during the operating time of the magnetic resonance apparatus.

The cast and/or laminated plug element can include at least one wire ring. The contact to the coil and the mechanical connection thereto can be established and ensured with this ring or with the assistance of other connection elements.

The employed high current coaxial connection is appropriately designed to carry a current of at least 500 A, in particular of at least 600 A. These are the type of currents that are required for gradient coils in magnetic resonance tomography and that the employed high current coaxial connection must accordingly be able to carry. For safety reasons it is preferred when the high current coaxial connection is also designed for higher currents, for example for currents of 700 A or more.

According to the invention, a connection of high current coaxial lines to gradient coils that is more vibration-insensitive, exhibits lower Lorentz forces and is more secure is achieved by the high current coaxial connection with the two coaxial spring contact elements and by the inventive gradient coil. The connection provides a tolerance compensation in the axis direction (thus in the longitudinal direction of the connection) without splitting the coaxial line into two individual conductors being necessary.

DESCRIPTION OF THE PREFERRED EMBODIMENTS

Figure 1:
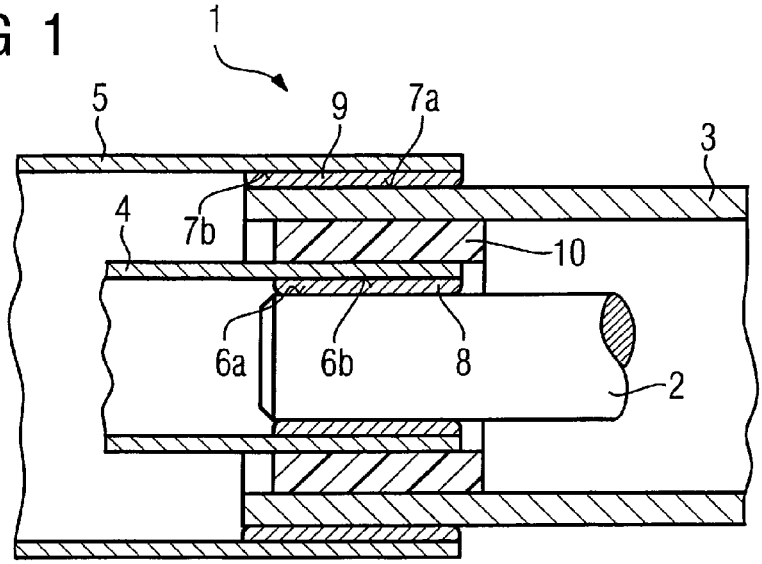
FIG. 1 illustrates the basic contacting principle of the inventive high current coaxial connection in a partially sectional view.

The contacting principle of an inventive high current coaxial connection 1 is shown in FIG. 1. A first plug element (not shown in more detail here and which is the plug element further removed from the gradient coil) has a central contact pin 2 with which the inner conductor of a coaxial line (not shown) connected with the plug element is in electrical contact. A bushing element 3 arranged radially further outwardly is electrically connected with the outer conductor of the coaxial line, for example by a welded or soldered connection.

The second plug element arranged at the gradient coil has a bushing element 4 situated radially further inwardly as well as a bushing element 5 arranged radially further outward. The surfaces of the contact pin 2 or of the bushing elements 3-5 (which are contact bushings) form electrical contact surfaces 6*a* and 6*b*, and 7*a* and 7*b*, for the connection of the inner conductor with the outer conductor, thus a complete connection possibility for both polarities. Two spring contact elements 8 and 9 are arranged between the respective contact surfaces 6*a*, 6*b* and 7*a*, 7*b*, via which spring contact elements 8 and 9 the electrical contact is established between the two plug elements, namely between the contact surfaces 6*a*, 6*b* and 7*a*, 7*b*. The contact surfaces 6*a*, 6*b* as well as 7*a* and 7*b*, like the spring contact elements 8 and 9, exhibit an axial alignment, thus an alignment parallel to the axis of the high current coaxial connection.

The inner region with the contact pins 2, the spring contact element 8 as well as the bushing element 4 is separated from the outer region with the bushing elements 3 and 5 and the spring contact element 9 via an insulator element 10. The spring contact elements 8 and 9 form cylindrical shells from composed of lamellae arranged in the axial direction (thus longitudinally). A certain tolerance range in the axial direction is thereby produced for the electrical contacting, such that a longitudinal displacement of the two plug elements counter to one another can be tolerated without interruption of the electrical contact.

Figure 2:
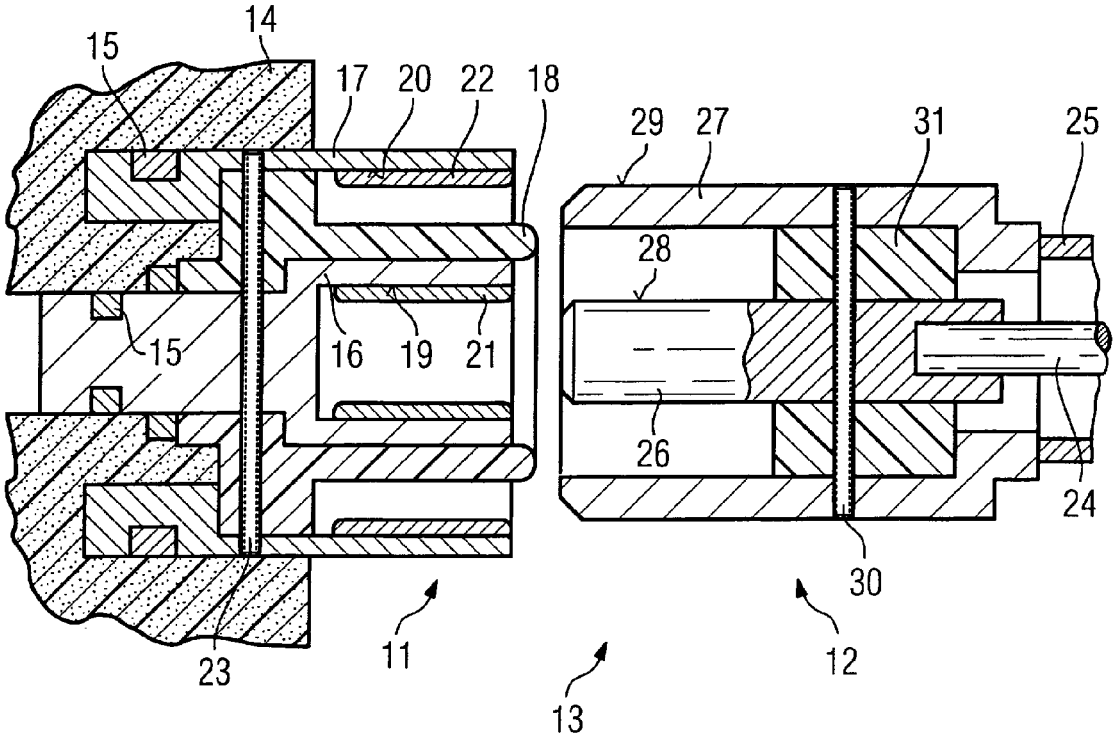
FIG. 2 shows the plug elements of an embodiment of an inventive high current coaxial connection in longitudinal section.

The plug elements 11 and 12 of an inventive high current coaxial connection 13 are shown in longitudinal section in FIG. 2. The plug element 11 is located partially in a sealing (potting) compound 14 in which it is cast together with the module to which current should be supplied via the plug element 11. Wire rings 15 are provided for strengthening the connection.

Relative to the axis of the coaxial connection the plug element 11, has a more axis-proximal contact bushing 16 as well as a more axis-distal contact bushing 17. An insulator element 17 is arranged between the two contact bushings 16 and 17.

The contact surfaces 19 and 20 of the contact bushings 16 and 17, via which the electrical contact to the corresponding contact surfaces of the other plug element 12 is established, are fashioned in the form of the cylinder shells. Spring contact elements 21 and 22 that serve for the direct electrical contacting between the two plug elements 11 and 12 are arranged on these contact surfaces 19 and 20.

The individual components of the plug element 11 are fixed in their position relative to one another by the pin element 23.

The second plug element 12, into which the coaxial line with the inner conductor 24 as well as the outer conductor 25 is inserted, has an inner bolt element 26 as well as an outer bushing element 27, the surfaces of which respectively exhibit contact faces 28 and 29 to establish the electrical contact in the overlapping region of the plugged connection. When the plug elements 11 and 12 are brought together, the respective contact faces 19 and 28 as well as 20 and 29 are brought into contact with one another via the spring contact elements 21 and 22, such that the electrical contact between the plug elements 11 and 12 of the coaxial connection is established for the two polarities via the spring contact element 21 and 22 associated with the conductors of the coaxial line. Due to the axial orientation of the spring contact elements 21 and 22, this contact is tolerant with regard to a certain longitudinal displacement; the contact thus remains unrestricted within certain limits even given forces acting in the longitudinal direction via which the two plug elements 11 and 12 are moved counter to one another.

The second plug element 12 also has a pin element 20 in order to fix the position of the components of the plug element 12 opposite to one another. The pin element 26 as well as the bushing element 27 are separated from one another by an insulator element 31.

Without further measures a coaxial connection that is in the position to bear even very high currents (for example the currents to supply a gradient coil) can thus be established with the two plug elements 11 and 12. A more secure contact is ensured by the two spring contact elements 21 and 22 (thus the two spring elements that are fashioned circumferentially around the axis of the coaxial connection) arranged coaxial to one another.

Figure 3A:
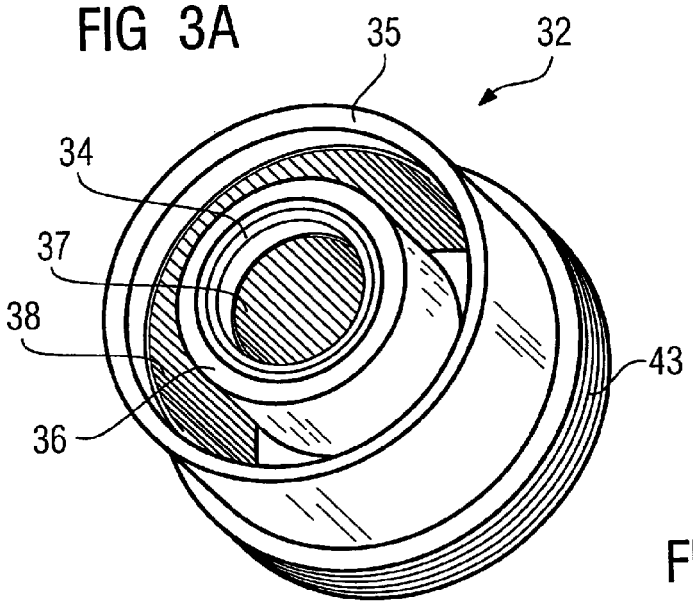
FIGS. 3A and 3B show two plug elements of an inventive high current coaxial connection.
Figure 3B:
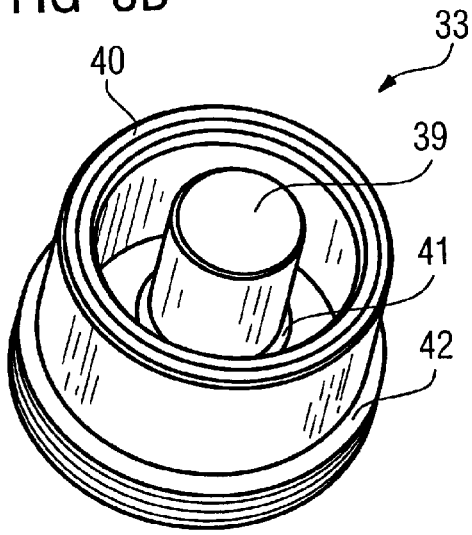

FIGS. 3A and 3B show views of the two plug elements 32 and 33 of an inventive high current coaxial connection. The plug element 32 of FIG. 3A has two bushings 34 and 35 between which an insulator element 36 is arranged. Spring contact elements 37 and 38 that surround the longitudinal axis of the plug element and are aligned coaxially to one another, the spring contact elements 37 and 38 respectively extending in the axial direction, are shown on the inner surfaces of the bushings 34 and 35. These spring contact elements 37 and 38 are respectively composed of individual lamellae that extend in the axial direction.

The plug element 33 of FIG. 3B forms the counterpart to the plug element 32 of FIG. 3A and correspondingly comprises an inner bolt 39 as well as an outer bushing 40. If the plug elements 32 and 33 are plugged into one another, the contact between the surface of the bolt 39 and the bushing 34 is established via the spring contact element 37 with its lamellae structure while the contact between the bushing 40 and the bushing 35 is mediated via the spring contact element 38. The contacts or connections for the different polarities are thus secured by the coaxial spring contact elements 37 and 38, wherein the lamellae structure of the spring contact elements 37, 38 particularly advantageously ensures a secure contact given a simultaneous axial tolerance.

A stop is provided via the cylindrical elements 41 and 42 upon plugging the plug elements 32 and 33 together. The cylindrical element 42, like the cylindrical element 43 of FIG. 3A, exhibits an outer threading that provides fixing capability. Furthermore, the elements can be fashioned as nuts via which the arrangement of the individual components of the plug element 32 and 33 are fixed relative to one another in cooperation with a collar.

Figure 4:
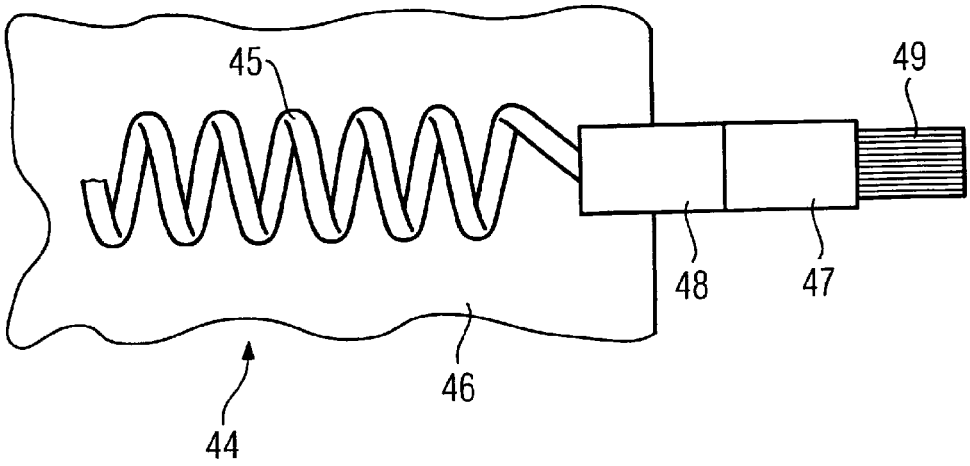
FIG. 4 schematically illustrates an inventive gradient coil with connected high current coaxial line.

FIG. 4 shows the basic principle of an inventive gradient coil 44 with a connected high current coaxial line 49. The gradient coil 44 is shown only schematically, with individual windings 45 being shown. The gradient coil 44 is cast in a sealing compound 46, wherein it is securely fixed in terms of position. The connection for the two polarities between the gradient coil 44 and the coaxial line 49 is achieved by two plug elements 47 and 48 in which the respective contacting with regard to the outer conductor and the inner conductor fed into the plug element 47 is established by a spring contact element that is arranged between contact surfaces of bushings and pins of the plug elements 47 and 48.

The contacting by means of the spring contact elements that are arranged coaxially to one another with regard to the axis of the coaxial connection enables a connection of the gradient coil 44 that is simultaneously vibration-insensitive, exhibits low Lorentz forces, and is secure.

Although modifications and changes may be suggested by those skilled in the art, it is the intention of the inventors to embody within the patent warranted hereon all changes and modifications as reasonably and properly come within the scope of their contribution to the art.

We claim as our invention:

1. A high current connection assembly comprising:

a magnetic resonance gradient coil comprising a first plug element;

a coaxial line for supplying current to said magnetic resonance gradient coil, said coaxial line comprising a second plug element, said first and second plug elements being configured to mate with each other in a plugged connection along an axial direction; and two spring contact elements carried by one of said first and second plug elements that are coaxially disposed in said one of said first and second plug elements that establish electrical contact between said first and second plug elements when said first and second plug elements are at least partially plugged together.

2. A connection assembly as claimed in claim 1 wherein said first plug element is structurally incorporated with said gradient coil by casting or lamination.

3. A connection assembly as claimed in claim 1 comprising a connection region between said first plug and said gradient coil, said connection region being surrounded by at least one wire ring.

4. A connection assembly as claimed in claim 1 wherein said first and second plugs and said two spring contact elements allow a current of at least 500 A to be supplied from said coaxial line to said gradient coil.

* * * * *